US007757589B2

(12) United States Patent
Kielland

(10) Patent No.: US 7,757,589 B2
(45) Date of Patent: Jul. 20, 2010

(54) MULTI-BIT, DUAL-MODE SCREWDRIVER FOR EITHER MANUAL OR POWERED ACTUATION

(76) Inventor: Peter Kielland, 310 Selby Avenue, Ottawa, Ontario (CA) K1Z 6R1

( * ) Notice: Subject to any disclaimer, the term of this patent is extended or adjusted under 35 U.S.C. 154(b) by 155 days.

(21) Appl. No.: 11/719,638

(22) PCT Filed: Mar. 23, 2006

(86) PCT No.: PCT/CA2006/000435

§ 371 (c)(1),
(2), (4) Date: May 17, 2007

(87) PCT Pub. No.: WO2006/102737

PCT Pub. Date: Oct. 5, 2006

(65) Prior Publication Data

US 2009/0235789 A1 Sep. 24, 2009

(30) Foreign Application Priority Data

Mar. 31, 2005 (CA) ..... 2505539

(51) Int. Cl.
*B25B 23/00* (2006.01)
*B25G 1/08* (2006.01)

(52) U.S. Cl. ..... 81/438; 81/490; 81/177.4

(58) Field of Classification Search ..... 81/438, 81/439, 177.4, 490, 177.85
See application file for complete search history.

(56) References Cited

U.S. PATENT DOCUMENTS

| | | | | | |
|---|---|---|---|---|---|
| 4,437,365 | A * | 3/1984 | Yaari | 81/177.85 |
| 4,924,733 | A * | 5/1990 | McKenzie | 81/438 |
| 5,595,099 | A * | 1/1997 | Pusateri | 81/177.85 |
| 5,752,418 | A * | 5/1998 | Robins | 81/177.85 |
| 6,029,549 | A * | 2/2000 | Baker | 81/439 |
| 6,305,255 | B1 * | 10/2001 | Wu | 81/439 |
| 6,435,065 | B2 * | 8/2002 | Kozak et al. | 81/490 |
| 6,629,478 | B2 * | 10/2003 | Kozak | 81/490 |
| 7,000,509 | B2 * | 2/2006 | Shiao | 81/490 |

* cited by examiner

*Primary Examiner*—Hadi Shakeri
(74) *Attorney, Agent, or Firm*—Gordon Thomson

(57) ABSTRACT

A dual-mode screwdriver has a manual and powered actuation mode achieved by inverting the screwdriver body. The screwdriver has a driveshaft having two ends each adapted for receiving the shank of a screwdriver bit. The body contains a plurality of slots for storing a plurality of screwdriver bits. Magnets are contained in each of the slots for retaining the bits within their respective slots. The outside surface of the body is contoured for hand gripping and torquing. The driveshaft is adapted for coupling to a powered drill.

5 Claims, 15 Drawing Sheets

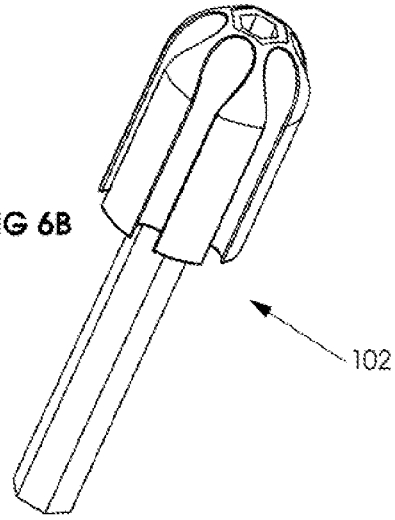
FIG 6B
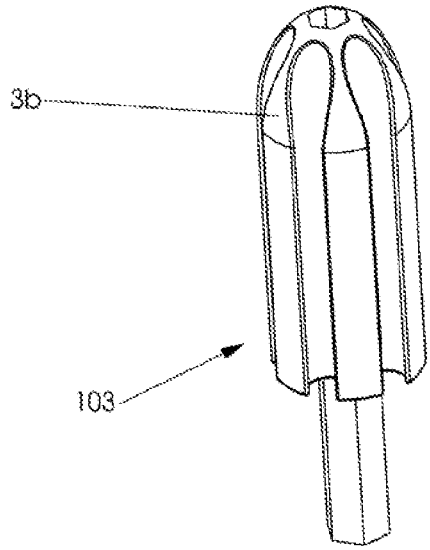
FIG 6C
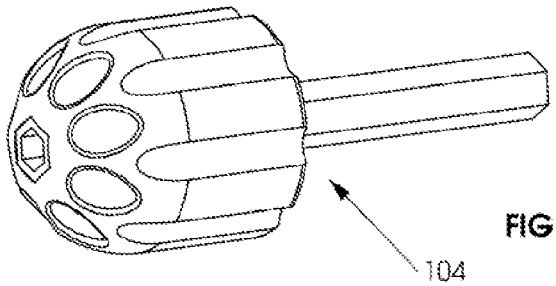
FIG 6D
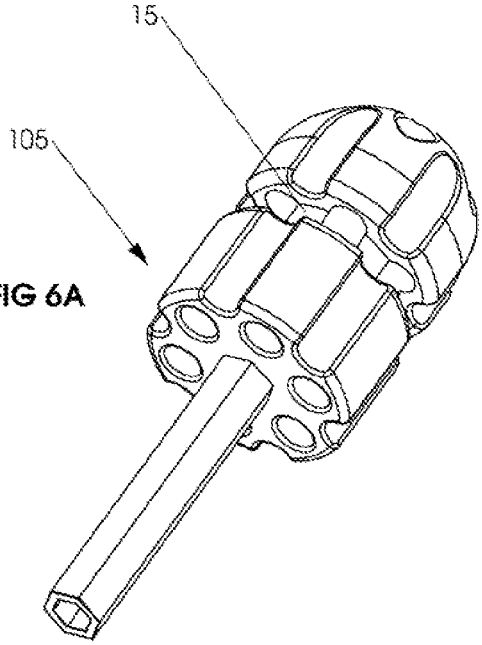
FIG 6A
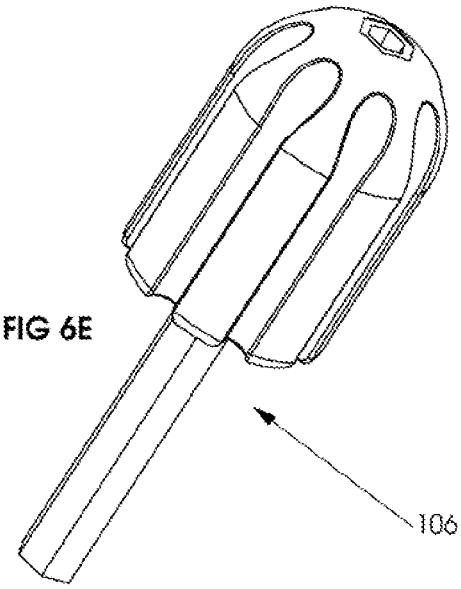
FIG 6E
FIG 6

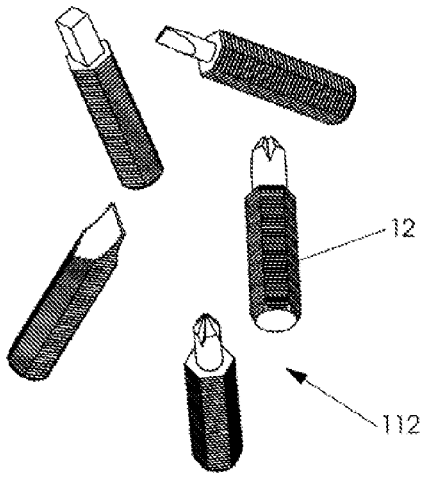
FIG 8B
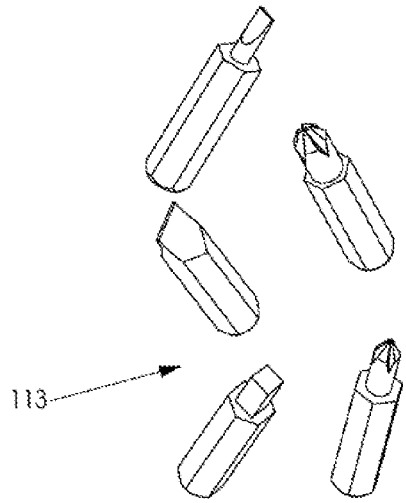
FIG 8C
FIG 8A
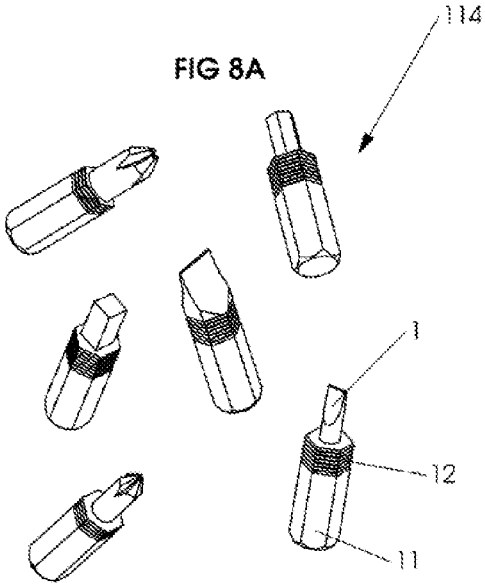
FIG 8D
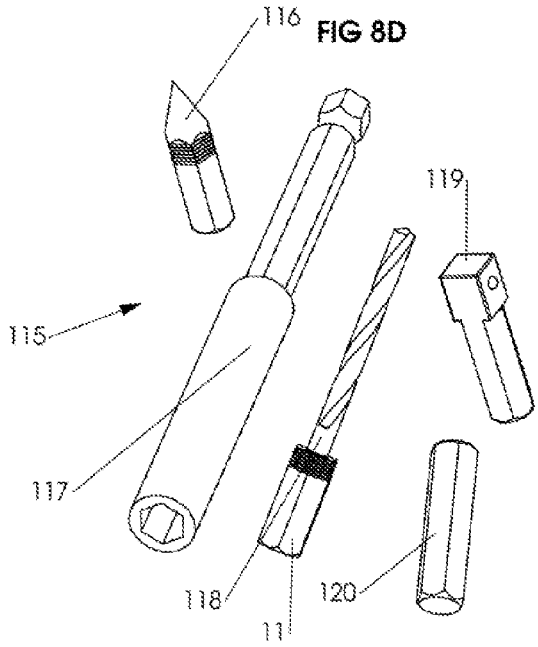
FIG 8

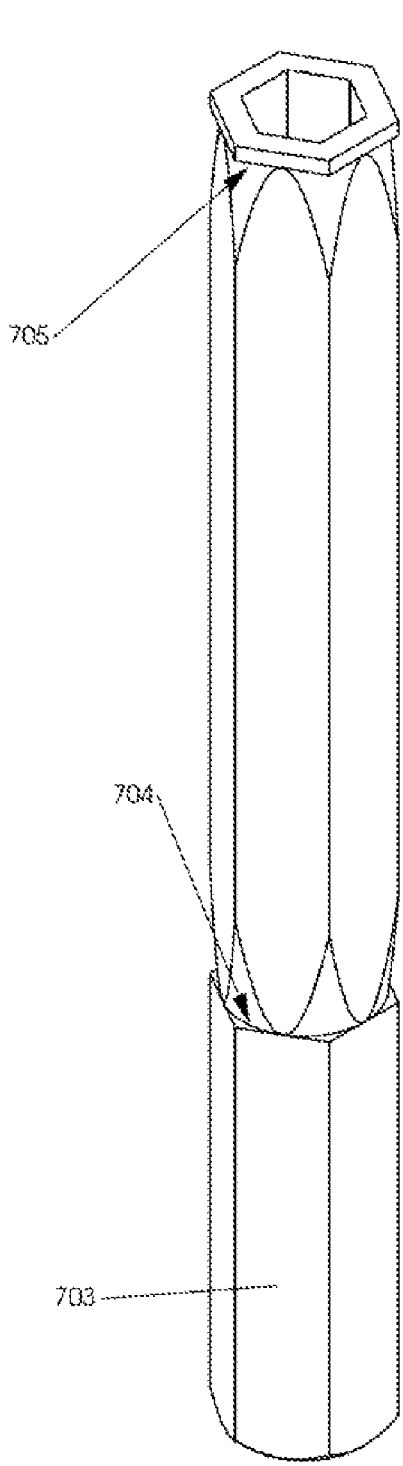
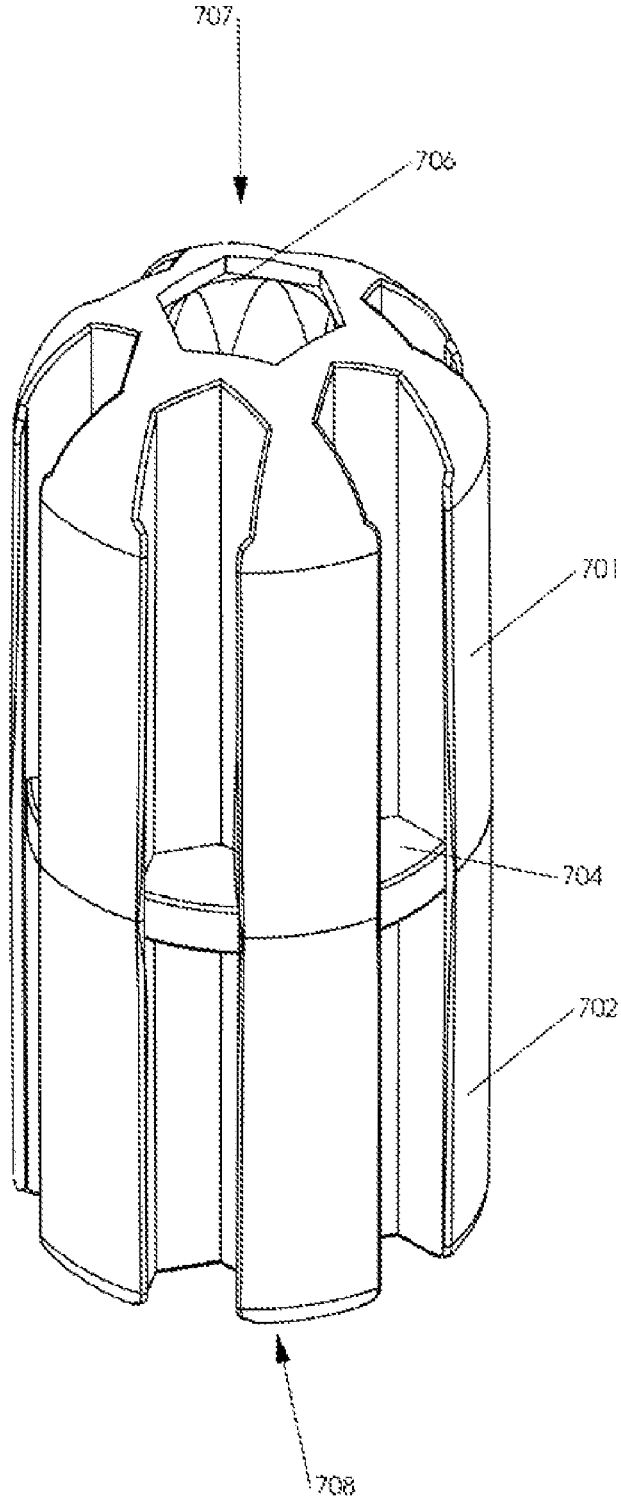
FIG 15A
FIG 15

MULTI-BIT, DUAL-MODE SCREWDRIVER FOR EITHER MANUAL OR POWERED ACTUATION

BACKGROUND

1. Field of the Invention

This invention comprises a screwdriver and more particularly it comprises a multi-bit, dual-mode screwdriver with integral bit storage and adapted for use in either a manual or powered mode of actuation.

2. Background of the Invention

Prior art replaceable-tip screwdrivers ("bit-holders") are generally for either handheld operation ("manual-driving mode") or for use with a powered means of rotation such as an electric drill ("power-driving mode").

Many prior art bit-holders exist for manual-driving. Relevant handheld devices are taught by: Kozak (U.S. Pat. No. 6,629,478), Cluthe (U.S. Pat. No. 6,332,384), Wu (U.S. Pat. No. 6,3052,55), McKenzie (U.S. Pat. No. 4,924,733), Kikel (U.S. Pat. No. 4,848,197) and Trincia (U.S. Pat. No. 4,434,828). These handheld devices suffer from either limited bit. storage capacity (generally six or less) or else utilize cumbersome and complex bit change mechanisms. Kikel's, Kozak's and Wu's device all teach an opposing bit socket configuration that enables the user to manually actuate either of two mounted bits, however none of them teach a power driving mode. Wannop (U.S. Pat. No. 6,601,483), Sato (U.S. Pat. No. 6,205,893) and Shiao (U.S. Pat. No. 6,134,995), Yanugi et al. (U.S. Pat. No. 5,673,600), Koehler (U.S. Pat. No. 5,325,745) and Orlitzky (U.S. Pat. No. 4,762,036) teach manual mode devices that provide more rapid and easy bit changing than the devices cited above however their extra degree of automation comes at the expense of greater bulk and mechanical complexity.

The other cluster of relevant prior art bit-holders are for actuation by powered means such as an electric drill: Beauchamp U.S. Pat. No. 6,761,095, Jui-Tung Chen (U.S. Pat. No. 6,742,421), Wadsworth (U.S. Pat. No. 6,752,268), Robison (U.S. Pat. No. 5,921,562), Hogan (U.S. Pat. No. 5,597,275) and Lore (U.S. Pat. No. 5,309,799) teach bit holders that operate exclusively in power-driving mode. They also require a fairly large rotating diameter which limits bit access into tight quarters.

My search of the prior art has revealed only one "dual-mode" bit holder. Pending application Beauchamp (US 20030079581) includes a threaded rear extension that can be attached to the handgrip portion of a manual screwdriver to render the device suitable for power-driving. Beauchamp's design requires a separate gripping adaptor to enable the device's power driving mode (his adaptor being screwed onto the rear portion of the handgrip as shown in his FIG. 17 and FIG. 29). This single-purpose gripping means complicates the device's construction as well as rendering it cumbersome to use.

In summary: the prior art devices suffer from one or more of several drawbacks:

1. They are limited to either manual-driving mode or power-driving mode.
2. Their bit storage capacity is too small to accommodate a wide selection of bits.
3. Their stored screwdriver tips are not readily visible, thereby slowing down the bit-selection process.
4. Their bit storage mechanism is bulky and/or cumbersome to manipulate.

5. Their handle for manual operation doesn't present an ergonomic means for applying axial force while turning the active screwdriver bit.
6. Their structure is complex with many discrete or moving parts.
7. Their screwdriver bits cannot be easily gripped by a user in order to pull them from their magnetic drive sockets.

It is therefore desirable to provide a simpler and more efficient screwdriver that can easily be used in either manual-driven mode or power-driven mode and that minimizes those drawbacks observed in the single-mode devices.

SUMMARY OF THE INVENTION

In accordance with the present invention a dual-mode screwdriver with integral bit storage for manual or powered rotation mode comprises a fabricated driveshaft having a first end and a second opposite end. Each end of the driveshaft is has a bit retention socket adapted for receiving a screwdriver bit. There is also included a molded body disposed around one of the driveshaft ends, hereinafter the body end. When the screwdriver is in the manual rotation mode the body is adapted for hand gripping and torquing and the driveshaft opposite end receives a screwdriver bit. When the screwdriver is in powered rotation mode the driveshaft opposite end couples to powered rotation means such as a drill and the driveshaft body end receives the screwdriver bit. The result is that the user may easily chose between manual rotation mode and powered rotation mode by either inserting the bit in the first end of the driveshaft and torquing the bit by hand or by inserting the bit in the body end and coupling the first end to a power drill.

Integrated bit storage comprises a plurality of screwdriver bit storage slots integral to the body. The slots are adapted to store at least one screwdriver bit.

In the preferred embodiment the driveshaft has a hexagonal cross-sectional profile to facilitate coupling with supplemental torque addition means during the manual rotation mode such as an open ended box wrench. In powered rotation mode the hexagonal profile of the driveshaft facilitates coupling with a keyless drill chuck.

In another embodiment of the invention, the driveshaft has a circular cross-sectional profile. In such an embodiment the driveshaft would couple with a powered drill chuck having a key for tightening against the cylindrical driveshaft.

The body is molded from a suitable plastic material. In one embodiment the plastic material has an elasticity to facilitate storage of the bits within the body. In another embodiment the plastic material is hard to facilitate placement of magnetic storage devices within the storage slots. The body may be molded directly to the driveshaft. However, in the preferred embodiment, the body is molded apart from the driveshaft and then disposed over the driveshaft and fixed into place on the driveshaft. The body has a domed end to facilitate ergonomic application of hand pressure during manual mode rotation and a flat opposite end for compactness. The body end of the driveshaft and the domed end of the body are flush. The first end of the driveshaft is located a predetermined distance from the flat end of the body. To provide optimal compactness in both operating modes, this predetermined distance is typically between 1 inch and 1.5 inches.

The screwdriver bits to be used with the dual-mode screwdriver comprise a bit end and a bit shank which may optionally include a knurled portion. The knurled portion is adapted to assist removal of the bit from storage slots integral to the body by sliding the thumb or finger over the knurled portion.

The bit storage slots are parallel to the driveshaft and distributed radially around the circumference of the body. The slots have a top open end, a bottom open end and an open side. At least one bit may be inserted into each slot. In this embodiment the body is molded from a softer plastic material so that the body integral slots have gripping flanges on each side of the slot. Since the softer plastic material has some elasticity the flanges will bias the bits within the slots and keep them from falling out.

In another embodiment of the invention there is a dual-mode screwdriver having integral bit storage for manual or powered rotation mode comprising a driveshaft having a first end and a second end and a body disposed onto the driveshaft. The driveshaft first and second ends each have a hexagonal socket adapted for receiving a screwdriver bit. The body is a single molded unit having first portion and a second portion that are joined together at their centers. A gap separates the first and second portions forming a view-port to view the bits stored inside the body. The body is disposed upon one end of the driveshaft; hereinafter the body end of the driveshaft. When the screwdriver is in the manual rotation mode the body is adapted for hand gripping and torquing. The driveshaft second end receives the screwdriver bit. When the screwdriver is in the powered rotation mode the driveshaft second end couples to powered rotation means such as a drill. The body end of the driveshaft receives the screwdriver bit.

In yet another embodiment of the body, there are disposed on the outside of the body a plurality of external, radially spaced and parallel hand-gripping grooves. These hand-gripping grooves are adapted to act as a handle for gripping and torquing the dual-mode screwdriver in the manual rotation mode.

The body has integral bit storage in the form of bit storage cavities in each of the top and bottom portions. The cavities have open top and bottom ends and closed sides. Each cavity is adapted to store one storage bit.

In another embodiment of the invention each of the slots or cavities include bit retention means comprising biasing means such as elastic ribs in each slot or cavity for biasing against the screwdriver bit while in the storage slot or cavity.

In yet another embodiment the bits are retained within their slots or cavities by magnetic means. There is a driveshaft and a body. The body is a two-piece body. Each piece has a plurality of storage slots or cavities. The top end of one body includes recesses in which magnets are inserted. This body is disposed first over the driveshaft first. The other body is then disposed over the driveshaft so that the magnets are located between the slots of the first body and the second body. The combined unit forms a handgrip/bit-storage container with magnetic bit retention means integral to the container.

In another embodiment of the invention a single ring-shaped disk magnet is disposed over the driveshaft and into a recess on the top surface of the first body placed on the driveshaft. The second body is disposed on the driveshaft over the first body so that the ring-shaped disk magnet is sandwiched between them.

A method of manufacturing a dual-mode screwdriver having a driveshaft and a two-piece body is disclosed. It comprises the steps of: fabricating a driveshaft having a first end and a second end; adapting the ends of the driveshaft to receive screwdriver bits by forming first and second hexagonal sockets into each respective end of the driveshaft; selecting a suitable plastic material for molding the two-piece body; molding the first body piece and the second body piece from the selected material so that the first body piece has a domed end for receiving axial loads from a human hand and a flat bottom for compactness and so that the second body piece has a flat top and bottom surface; forming a plurality of bit storage slots within the first and second body pieces; disposing a recess into the top end of each slot in the second body piece; fitting a magnet into each recess for bit retention; placing the second body piece onto the driveshaft and fixing it in to place; and placing the first body piece onto the driveshaft and fixing it in place so that the domed end of the first body piece is flush with the driveshaft end; and so that the magnets are sandwiched between the first and second body pieces thereby forming a handgrip/bit-storage container having upper and lower storage slots and magnetic bit retention means.

In an alternative embodiment of the invention there is a single ring-shaped disk magnet that is disposed within a recess within the top surface of the second body flat top surface. The second body and ring-shaped magnet are placed over the driveshaft and fixed in place. The first body is placed over the second body and fixed in place thereby sandwiching the disk-shaped magnet between them thereby forming a handgrip/bit-storage container having magnetic bit retention means.

OBJECTS AND ADVANTAGES OF THE INVENTION

It is one object of my invention to provide a dual-mode screwdriver that can be used as a handheld screwdriver or an electric drill-powered screwdriver.

It is another object of my invention to provide a dual-mode screwdriver that does not need a special adaptor in order to convert it from handheld to drill-powered mode.

Another object of the invention is to provide a dual-mode screwdriver having integral bit storage.

Still another embodiment of the invention is to provide dual-mode screwdriver with integral bit storage in the form of a handgrip/bit-storage container.

A further object of my invention is to provide a handle having an ergonomic handgrip for applying axial hand force to the screwdriver when it is being used manually.

A still further object of my invention is to provide screwdriver bits that are easily and quickly changed without resorting to complex internal mechanisms.

Another object of my invention is to provide a dual-mode screwdriver wherein the bits are magnetically stored within the screwdriver body such that they are close to the point of use and easily manipulated.

Another object of my invention is to provide knurled screwdriver bits that facilitate their disengagement from magnetic retention means and their manipulation within the storage slots.

Another object of the invention is to provide a dual-mode screwdriver that can be switched rapidly from end to end when in the manual operating mode.

Another object of the invention is to permit storage of the screwdriver bits in groups of common tips adjacent to each other for rapid identification.

A further object of the invention is to provide a dual-mode screwdriver that has a high bit storage capacity and can reach into tight spaces.

A further object of the invention is to permit torque multiplication by using a wrench gripped onto its hexagonal main driveshaft.

A further object of the invention is manufacturing the dual-mode screwdriver easily and inexpensively with no moving parts and a minimal use of materials.

Additional objects and advantages of my invention will be clear from the following drawings and description.

BRIEF DESCRIPTION OF THE DRAWINGS

FIGS. 6A to 6E illustrate an overview of some various embodiments of the handgrip/bit-container according to the present invention.

FIGS. 8A to 8D illustrate four embodiments of tool bit sets configured for use with the present invention. Knurled surfaces are shown that facilitate bit removal from the magnetic bit-holder and specialty adaptors are shown that increase the tool's versatility.

FIGS. 15A to 15B illustrate a glue-free assembly methodology for joining the components.

DETAILED DESCRIPTION OF PREFERRED EMBODIMENTS

Figures 1, 1A:
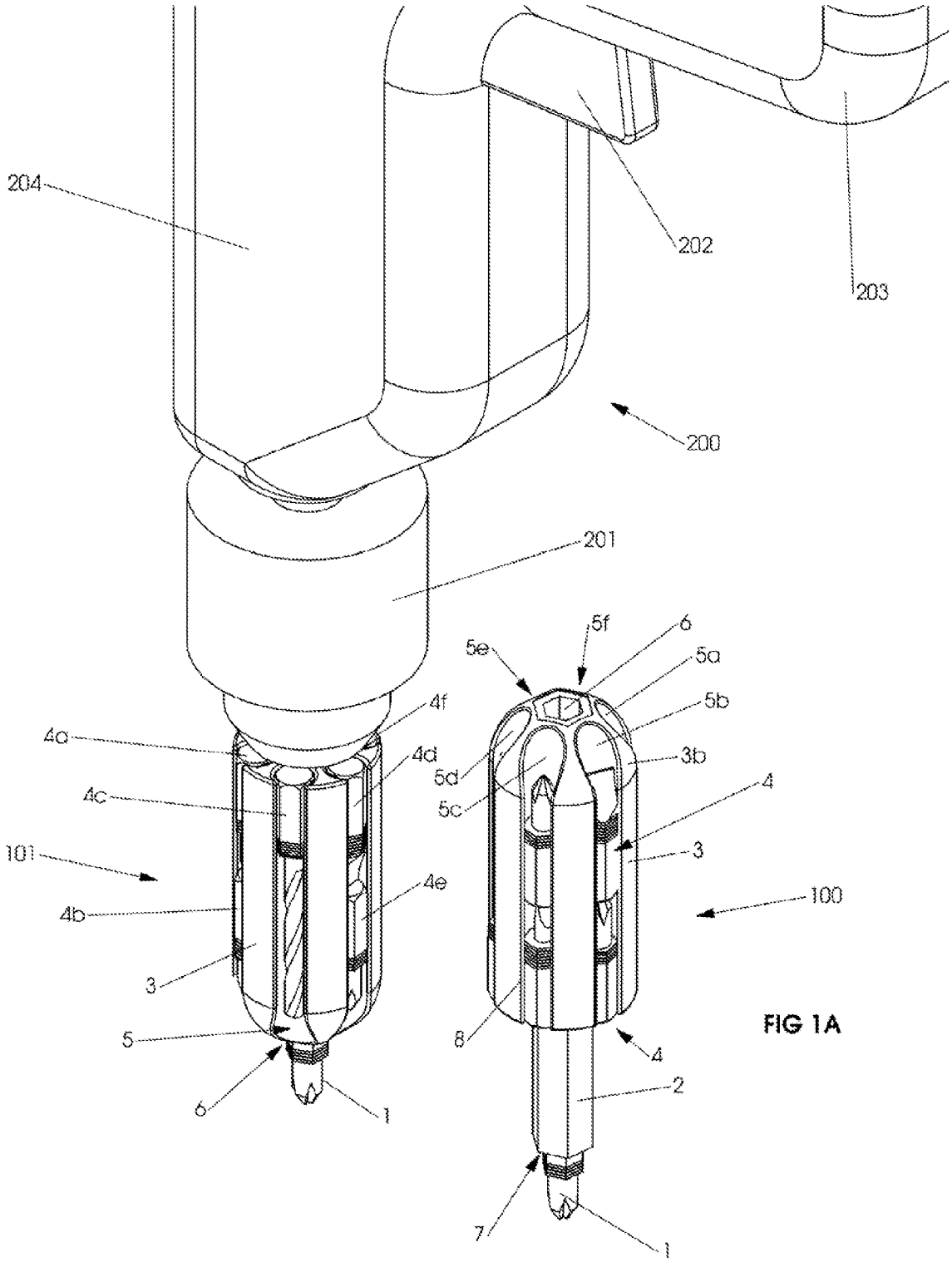
FIG. 1 illustrates an embodiment of the present invention optimized for actuation by an electric drill.
FIG. 1A illustrates the embodiment of FIG. 1 showing it in its manual screwdriver mode. Open-sided bit storage slots are shown in the handgrip that permits bit manipulation without interference from the drill chuck.

FIG. 1 illustrates two instances of a multi-bit screwdriver fashioned according to the present invention and shows the device configured in both of its manual and power-driven modes. Configuration 100 is its manual-driven mode and configuration 101 is the same device configured in power-driven mode with actuation by electric actuation means 200. Electric actuation means 200 is a typically a common electric drill having a handle portion 203, a motor housing 204, a speed control trigger 202 and a rotatable chuck 201. The chuck has adjustable internal gripping means (not illustrated).

The invention is comprised of driveshaft 2 and a molded body adapted as a handgrip/bit-storage container 3 disposed over the driveshaft. The handgrip/bit-storage container is fixed into place on the body end of the driveshaft with fixing means such as suitable adhesive but other means are possible such as molding the container directly to the driveshaft. The driveshaft has a first end and a second end and includes bit retention sockets 6 and 7 in each of the ends. The sockets include means for retaining the screwdriver bit within the drive-sockets 6 and 7 located at the body end of the driveshaft and the opposite end of the driveshaft (magnets are typically used however mechanical bit-gripping means are also suitable). When used in manual driven mode (100), active screwdriver bit 1 is gripped in drive-socket 7 formed into the end of the exposed length of screwdriver driveshaft 2 while the user applies torque onto handgrip/bit-storage container 3. When used in power-driven mode (101), active screwdriver bit 1 is gripped in drive-socket 6 while screwdriver shaft 2 is gripped in drill chuck 201 for rotation.

A plurality of bit-storage slots 5 (numbered 5*a*, 5*b*, 5*c*, 5*d*, 5*e* and 5*f*) are formed longitudinally within handgrip 3 and configured for storage of unused bits 4 (numbered 4*a*, 4*b*, 4*c*, 4*d*, 4*e*and 4*f*). The total number of storage slots is typically six however more or fewer slots may also be used. The total number of stored bits is typically twelve however storage for more or fewer bits may also be provided. The slots have an open top end and an open bottom end and an open side.

In another embodiment (not illustrated) no bit-storage slots are formed in the handle however the invention may still be used in either of its dual-driving modes (in this case, separate storage means for the unused bits are typically provided).

Figure 2:
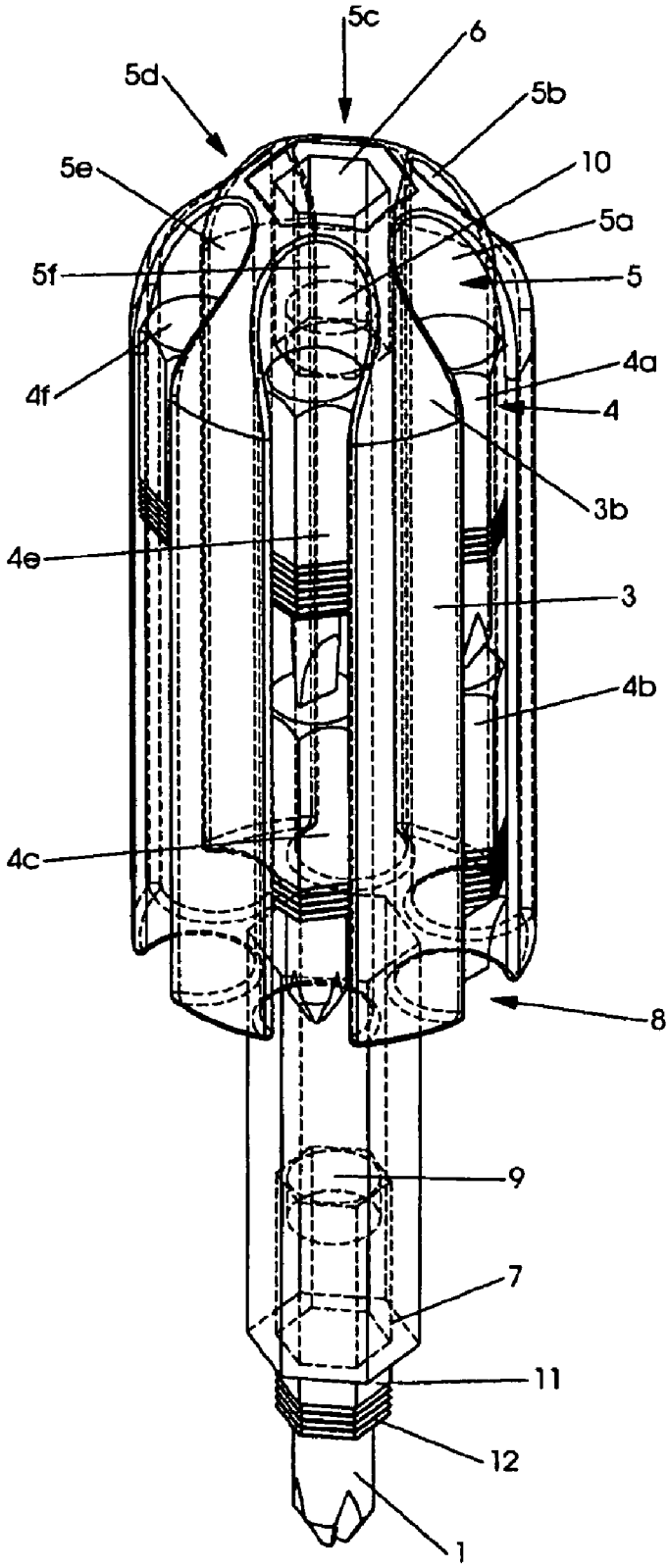
FIG. 2 is a large-scale illustration of the device shown in FIG. 1, showing it configured for manual actuation and with internal details shown as hidden lines.
Figure 3:
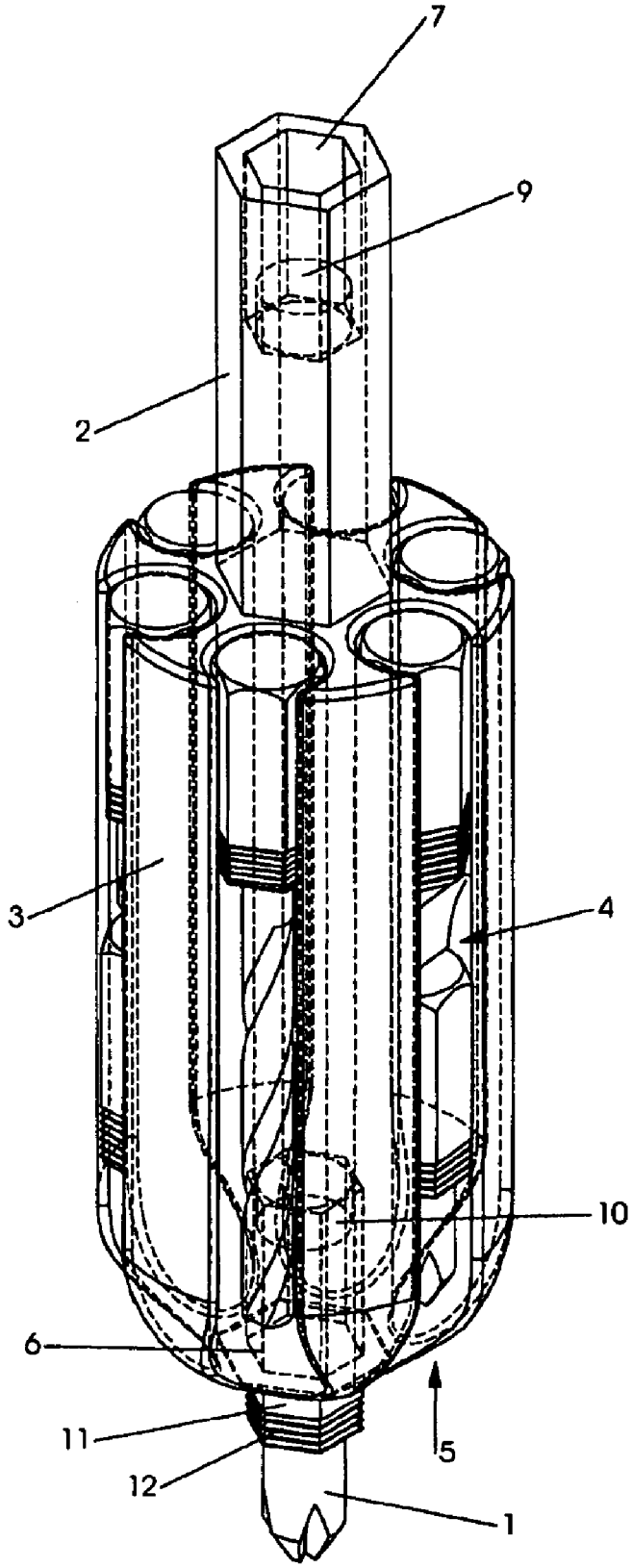
FIG. 3 is a large-scale illustration of the device shown in FIG. 1, showing it configured for actuation by an electric drill and with internal details shown as hidden lines.
Figures 4, 4A:
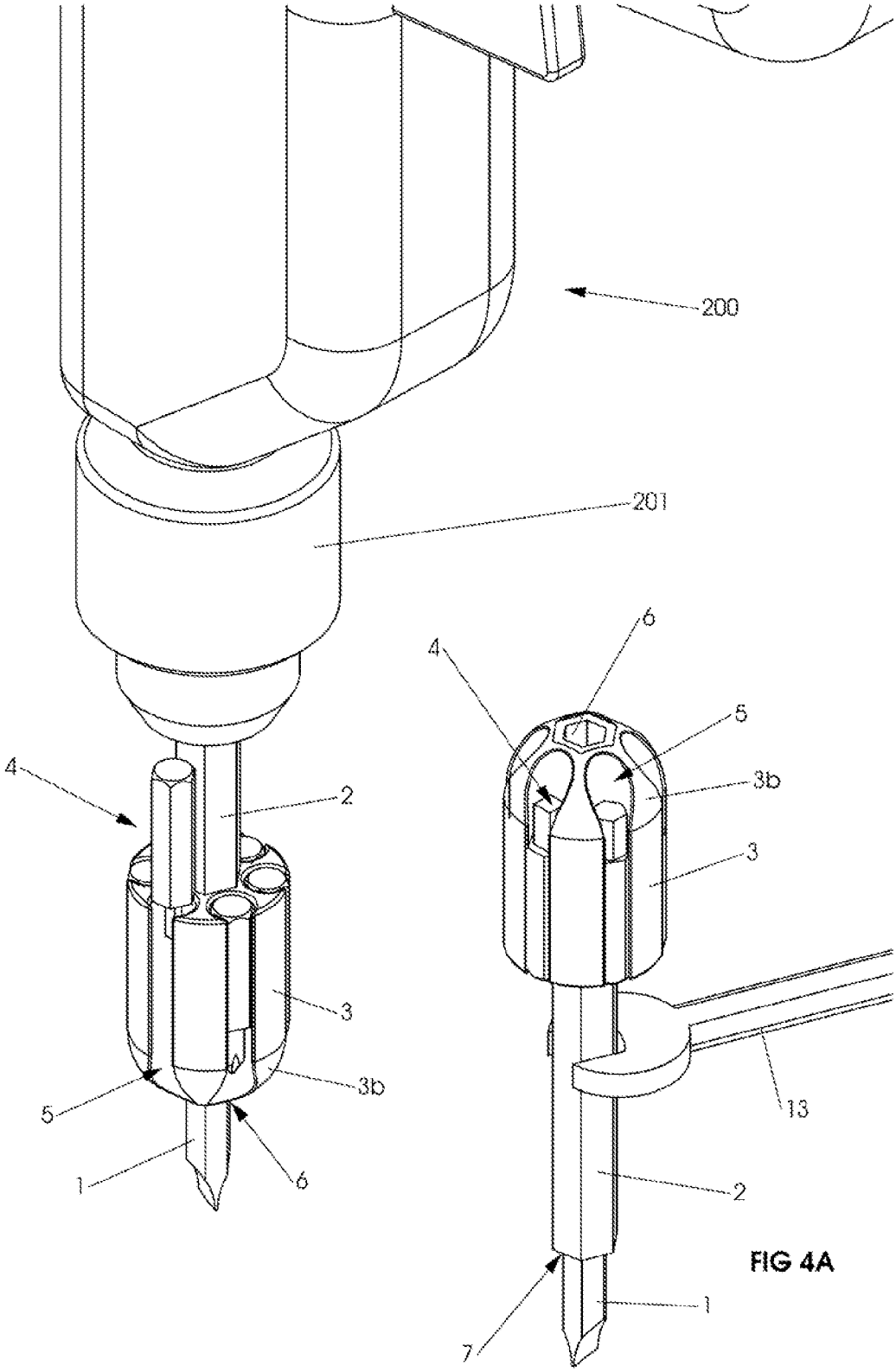
FIG. 4 illustrates a somewhat longer embodiment than that shown in FIG. 1, having a screwdriver shaft long enough to permit bit insertions into the storage handle using a single motion from the rear and without interference from the drill chuck.
FIG. 4A illustrates the embodiment of FIG. 4 in manual mode being used in conjunction with a wrench to multiply torque application.
Figure 7:
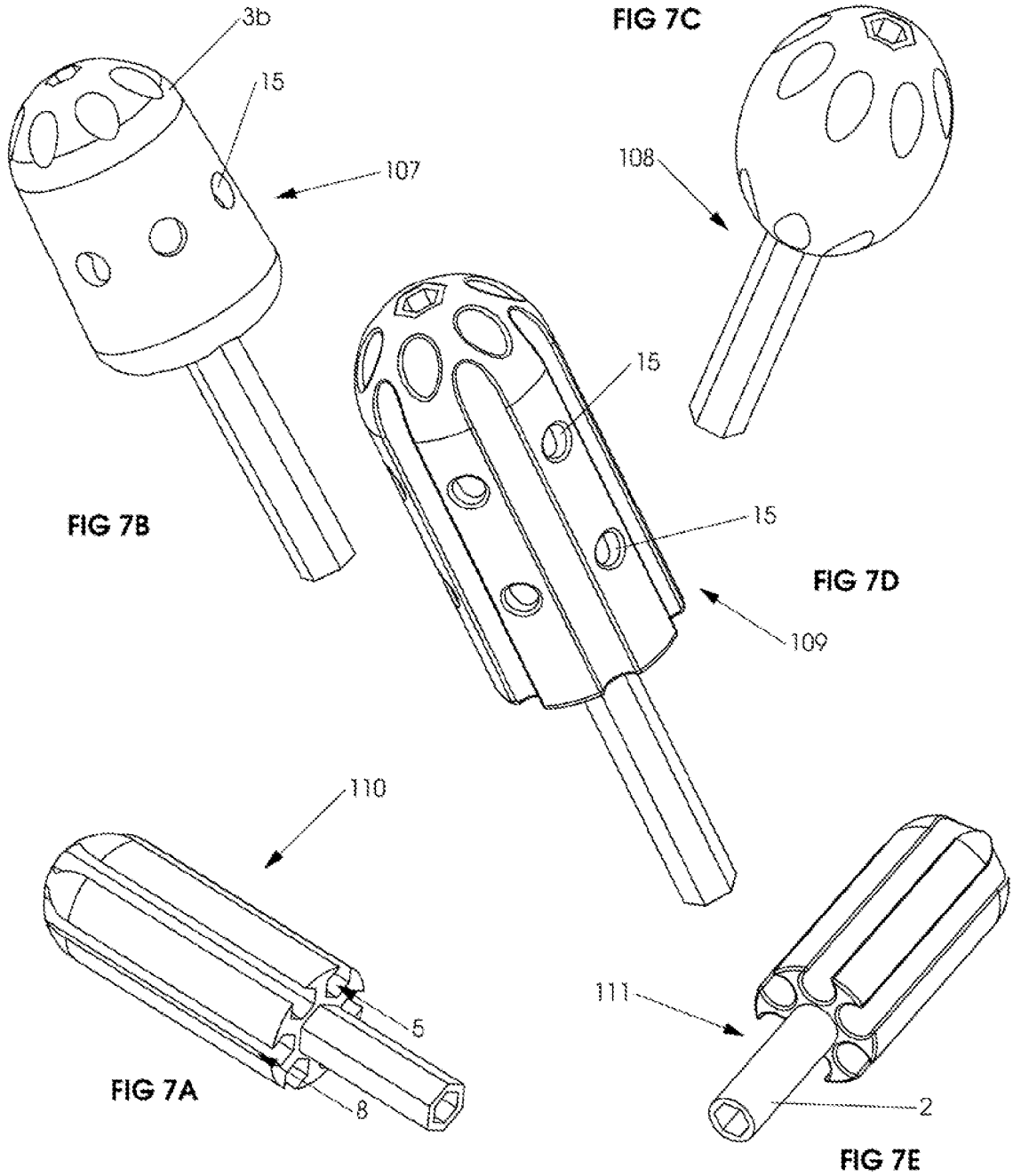
FIGS. 7A to 7E illustrate an overview of other various embodiments of the handgrip/bit-container according to the present invention.

Referring to FIG. 2, FIG. 3 and FIG. 4, screwdriver shaft 2 is typically hexagonal in cross-section, thereby permitting a standard open-end box wrench 13 to be used to grip any location along its length to apply greater torque if needed. The driveshaft's hexagonal cross-section also facilitates gripping the driveshaft in three-jaw chuck 201 without the need to apply great gripping pressure onto it. Alternatively, driveshaft 2 may have a circular outer cross-section (as shown in configuration 111 of FIG. 7) this cylindrical form will generally require the use of a chuck key to provide adequate grip. Driveshaft 2 is a fabricated metal rod that typically is contiguous throughout the entire length of screwdriver 100 and has its plastic handgrip/bit-container 3 disposed onto it and fixed into place using fixing means.

In another embodiment, the handgrip/bit-container is molded directly onto the driveshaft. Another implementation of driveshaft 2 (not illustrated) may be comprised of separate upper and lower drive socket portions that are effectively joined into a monolith within molded handgrip/bit-storage container 3. If handgrip/bit-storage container 3 is formed of material that is sufficiently strong to withstand the torque of driving bit 1, then drive socket 6 may be molded directly within it rather than being formed as a discrete metal insert.

In its preferred embodiment, the exposed portion of screwdriver driveshaft 2 is no longer that needed to permit good gripping in typical three-jaw drill chuck 201. Approximately 1" of exposed driveshaft provides adequate gripping while rendering the overall dimensions of the device pocket-sized for easy transport.

Figure 5:
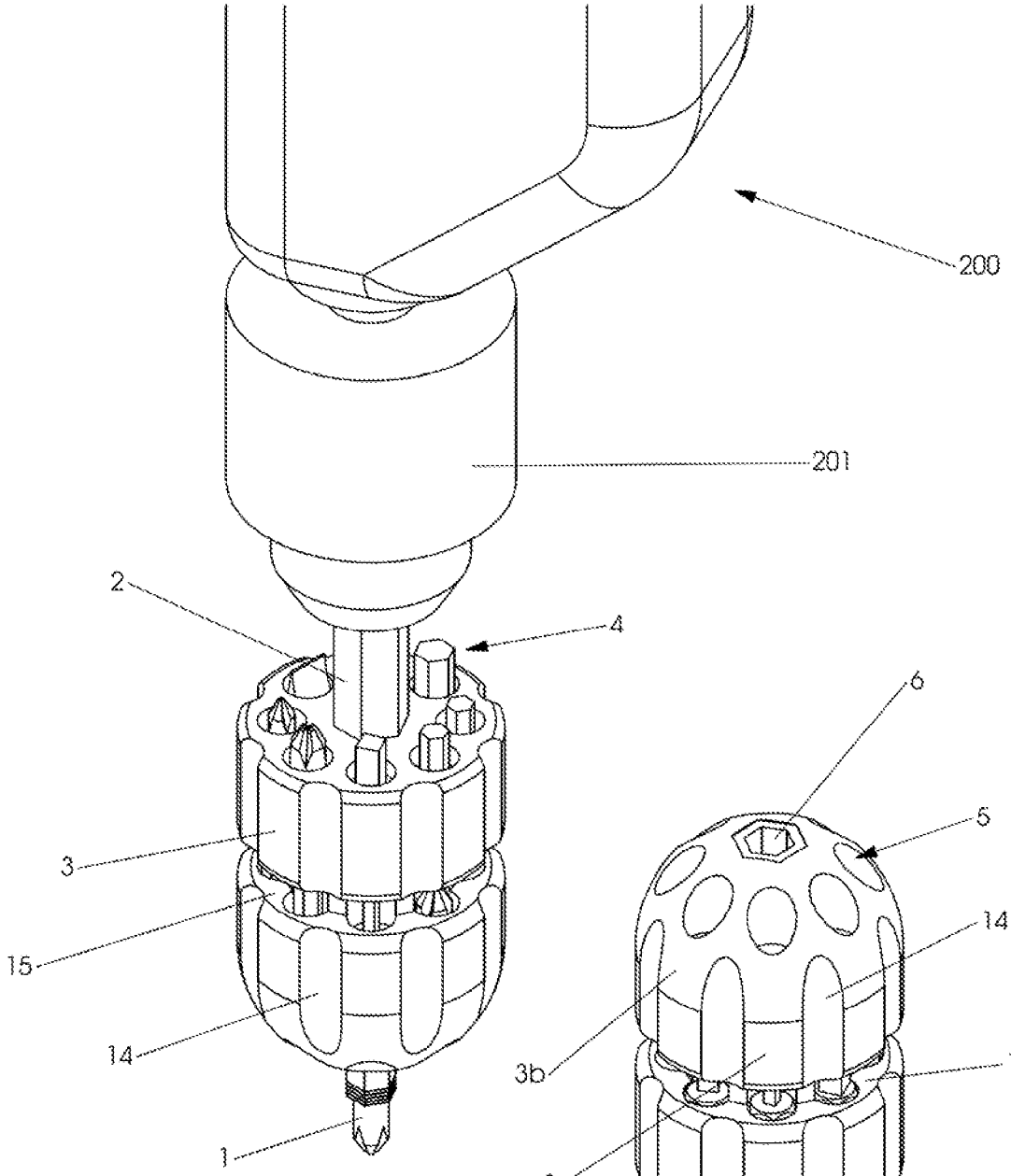
FIG. 5 illustrates an embodiment it in its power driven mode.
Figure 5A:
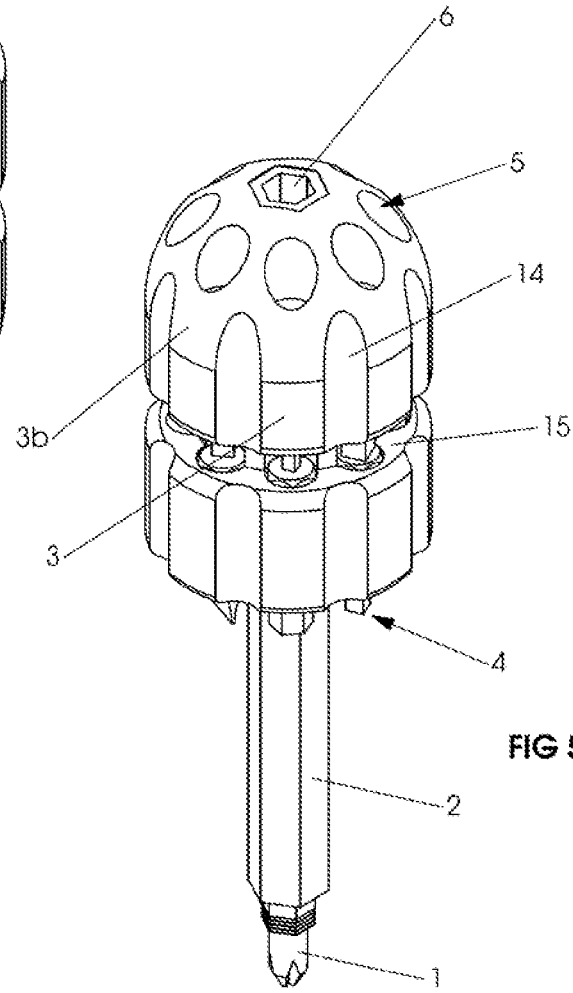
FIG. 5A illustrates the embodiment of FIG. 5 in its manual screwdriver mode.

In the embodiments shown in FIG. 4 and FIG. 5, driveshaft 2 is long enough to permit bits 4 to be pushed free of their respective open-sided storage slots 5 (in FIG. 4) or closed-sided storage cavities 5 (in FIG. 5) without interference from drill chuck 201 (i.e. the active bit 1 that's just been removed from drive-socket 6 or 7 can be inserted to push the desired stored bit 4 out from its storage slot 5). This bit manipulation technique can be helpful when used with open-sided storage slots such as those shown in FIG. 4 however it's a virtual necessity when used with closed-sided storage cavities such as those shown in FIG. 5.

Figure 10:
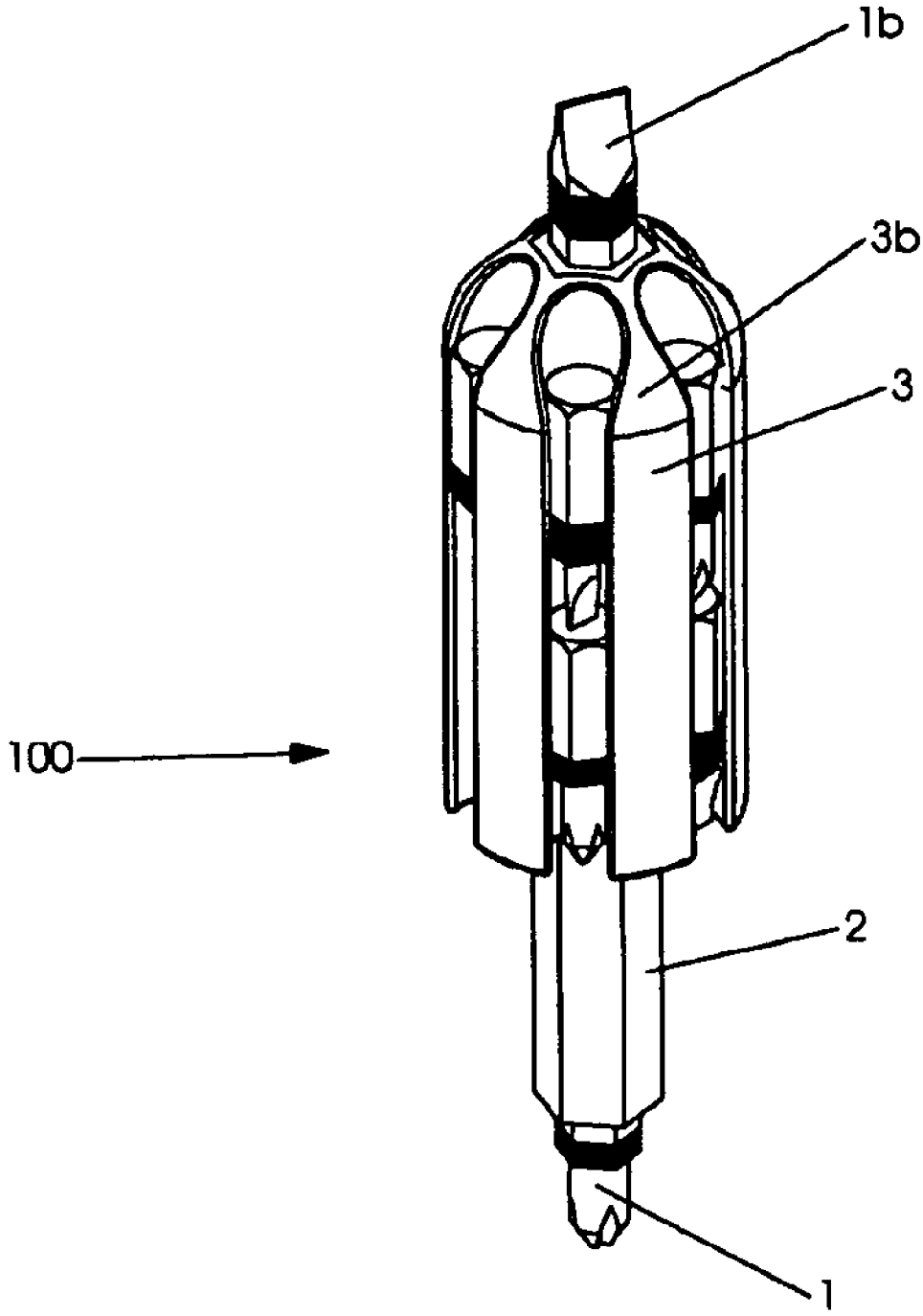
FIG. 10 illustrates the invention used in manual mode wherein both drive sockets are occupied at the same time by different screwdriver bits, thereby permitting rapid switching between screw types by simply flipping the device end-for-end.

Typically using a bit to eject a stored bit requires having at least 2"~2.5" of exposed driveshaft in order to permit secure gripping it in drill chuck 201. For most applications, the shortest possible driveshaft is preferable. FIG. 10 illustrates typical size and proportions portrayed at a 1:1 scale.

Referring back to FIG. 2: drive sockets 6 and 7 each include means for temporarily retaining active screwdriver bit 1 such that the user can manually withdraw it for exchange with one of the bits 4 stored within handgrip/bit-container 3. In FIGS. 2 and 3, the bit-retention means are comprised of magnets 9 and 10 affixed to the bottom of the drive-sockets, thereby exerting the required retention force onto (ferrous) bit 1. Other bit retention means are also possible: for example, spring clips (not illustrated) may be embedded within drive-sockets 6 and 7 to apply side friction onto shank 11 of bit 1.

Screwdriver driveshaft 2 and its included bit drive-socket 7 protrude from the lower end of handgrip/bit-storage container 3 however its upper end and drive-socket 6 are formed flush to the handgrip's rounded upper end 3*b*, thereby forming an ergonomic surface for applying substantial axial hand pressure onto a difficult work piece such as a rusted Phillips-head screw. While driveshaft 2 may have various shapes and sizes of cross-section, it is typically comprised of an approximately ⅜" wide hexagonal metal rod (facet to facet) that has a ¼" wide by approx. ⅜" deep hexagonal drive socket 6 and 7 formed into each of its ends. The ⅜" hexagonal outer drive-shaft dimension provides a 1/16" thick wall for each ¼" drive-socket (sufficiently thick to permit the use of aluminum). This dimensioning also permits a standard ⅜" wrench to assist manual torque application when dealing with difficult to remove screws (see FIG. 4). This general dimensioning scheme may be appropriately scaled to enable its use of with less common screwdriver bits having shanks larger or smaller than ¼" (for example: miniature 4 mm hex shank bits).

Open-sided storage slots such as those shown in FIG. 1 permit the user to reach in from the side and slide bits out either of the slot's un-obstructed ends. This capability permits the bit-container 3 to be mounted flush against drill chuck 201 using a short driveshaft 2. The storage slot's open side 8 is formed wide enough to permit the user's fingernail to engage a stored bit and push it out either end. The slot may have slightly filleted edges to improve comfort while sliding bits 4 within their storage slot 5. Furthermore, when the material used to mold the handgrip/bit-storage container is softer and somewhat elastic, the edges will elastically bias the bits within each slot thereby retaining them in place. When the material used to mold the handgrip/bit-storage container is hard (i.e. when the preferred magnetic bit-storage retention means are use), the slot edges need only reach a small distance over the two exposed bit shank facets in order to provide adequate radial retention force (see FIG. 14). Users with short fingernails may elect to use the tip of a removed bit to reach through slot 8 and push the stored bit out the slot's unobstructed end. The shanks of the bits may also be knurled to assist the user to manipulate the bits in the slots. This is illustrated in FIG. 8.

To maximize the speed of bit changes, the user may store bits in either possible orientation: FIG. 2 illustrates bits 4 pointed towards manual drive-socket 7 for optimal manual-driven operation while FIG. 3 illustrates said bits pointed towards drive-socket 6 for optimal power-driven operation.

In order to apply retention friction onto the sides of stored bits 4 within their respective storage slots 5, handgrip/bit-storage container 3 may be molded of slightly soft elastomeric material. Molding the handgrip/bit-container out of material such as Santoprene or low-density polyethylene having a hardness in the shore hardness range of D40 to D50 can provide adequate storage slot friction characteristics however a variety of other moldable or machinable materials are also suitable. The diameter of bit storage slots 5 is slightly smaller than the maximum vertex-to-vertex dimension of a standard ¼" screwdriver bit (approx 0.280"). The vertices of each hexagonal screwdriver bit thereby have a slight interference fit into their respective slot such that the bit slides easily and smoothly through its length while still retaining sufficient friction to prevent their falling out accidentally. Whether open-sided storage slots as in FIG. 1 or closed-sided storage cavities as in FIG. 5, the parallel disposition of each storage slot or cavity axis with respect to the axis of driveshaft 2 insures that even high-speed rotation of drill 200 will not cause any stored bits to be inadvertently ejected. The top and bottom edges of the storage slots 5 may be slightly filleted to facilitate smooth bit insertion.

Storage cavities 5 may be cylindrical as shown in FIG. 5 however cross-sectional shapes other than circular are also within the scope of the present invention. For example, the embodiment 110 in FIG. 7 utilizes open-sided, hexagonal shaped bit-storage slots 5 that closely fit standard screwdriver bits. The advantage of using hexagonal slots is that a vertex of each stored bit will be centered in its access slot, thereby facilitating the task of gripping it with a fingernail (see FIG. 12 for detail).

Figure 11:
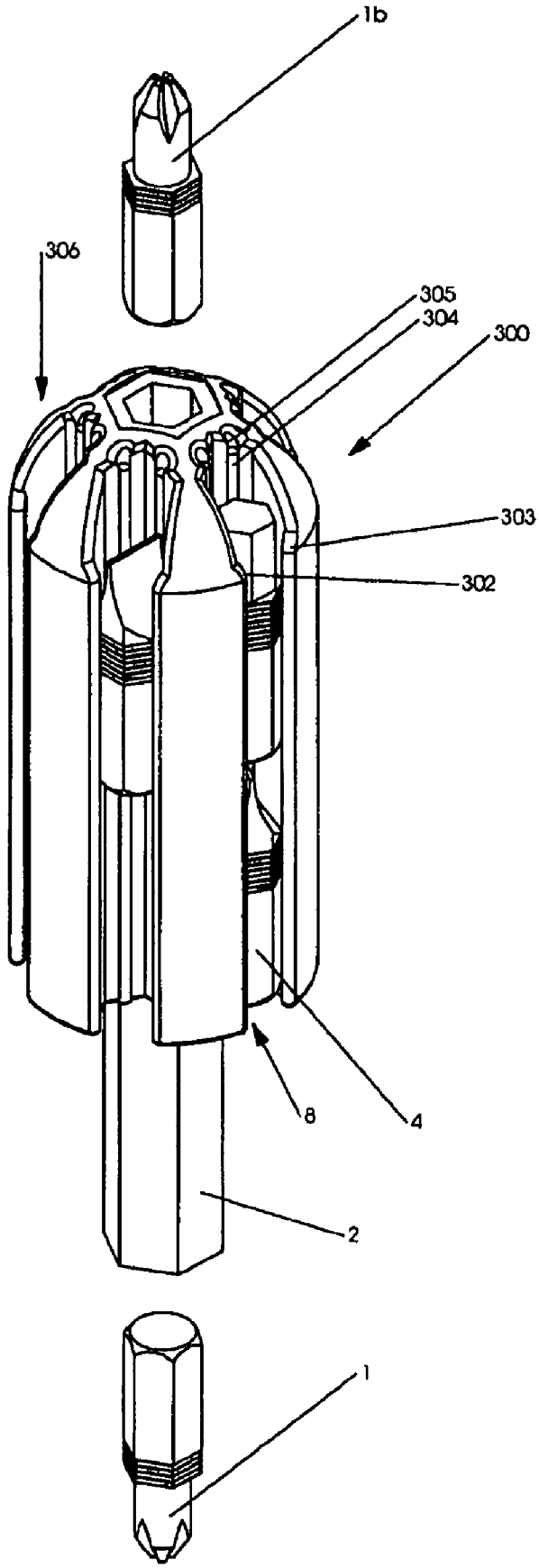
FIG. 11 illustrates details of bit-storage retention means that include a soft, high friction element formed along the interior of each bit-storage slot.

Other means of frictionally retaining unused screwdriver bits within their respective storage slots may be provided. One such alternative is to mold the handgrip/bit-container structure from hard material having oversized bit-storage slots that permit bits to slide freely through them. To prevent the bits from sliding out accidentally, small projections within each slot (e.g. springs or soft rubber inserts) are provided to hold each bit tight against the wall of its slot. FIG. 11 illustrates an example of this embodiment 300. Its handle/bit-storage portion 301 is molded from a rigid material such as ABS or polycarbonate and one or more, much softer and resilient protrusions 304 are formed onto one or more walls of it slots 306. In this example, the plurality of slots 306 is hexagonal and resilient protrusions 304 are beads of neoprene pressed into grooves 305 which are formed along said slots. Similar resilient protrusions may be formed in situ onto flat slot walls using common extrusion or adhesive technology. The effect of resilient protrusions 304 is to push inserted screwdriver bits 4 against slot edges 302 and 303 of slot 8, thereby providing a bit retaining force with ergonomic smoothness and holding characteristics.

Handgrip/bit-storage container 3 typically has six bit-storage slots 5*a*, 5*b*, 5*c*, 5*d*, 5*e* and 5*f*, (one disposed along each.

facet of hexagonal driveshaft 2 for maximum compactness). When used in conjunction with a larger diameter handgrip such as that shown in FIG. 5, more than six storage slots may be provided to increase bit-storage capacity.

Handgrip/bit-storage container 3 has a somewhat domed end 3*b* to improve comfort as the user grips it tightly or presses axially onto the end of its substantially cylindrical form. The upper domed portion 3*b* may be hemispherical as shown in FIG. 2 however greater curvatures such as that shown in 103 of FIG. 6 or lesser curvatures such as that shown in 107 of FIG. 7 or in FIG. 15 may also be used. The handgrip's lower edge and side curvatures may also be varied to provide a more comfortable grip (such as shown in 107 and 108 of FIG. 7 or in FIG. 15).

Figure 12:
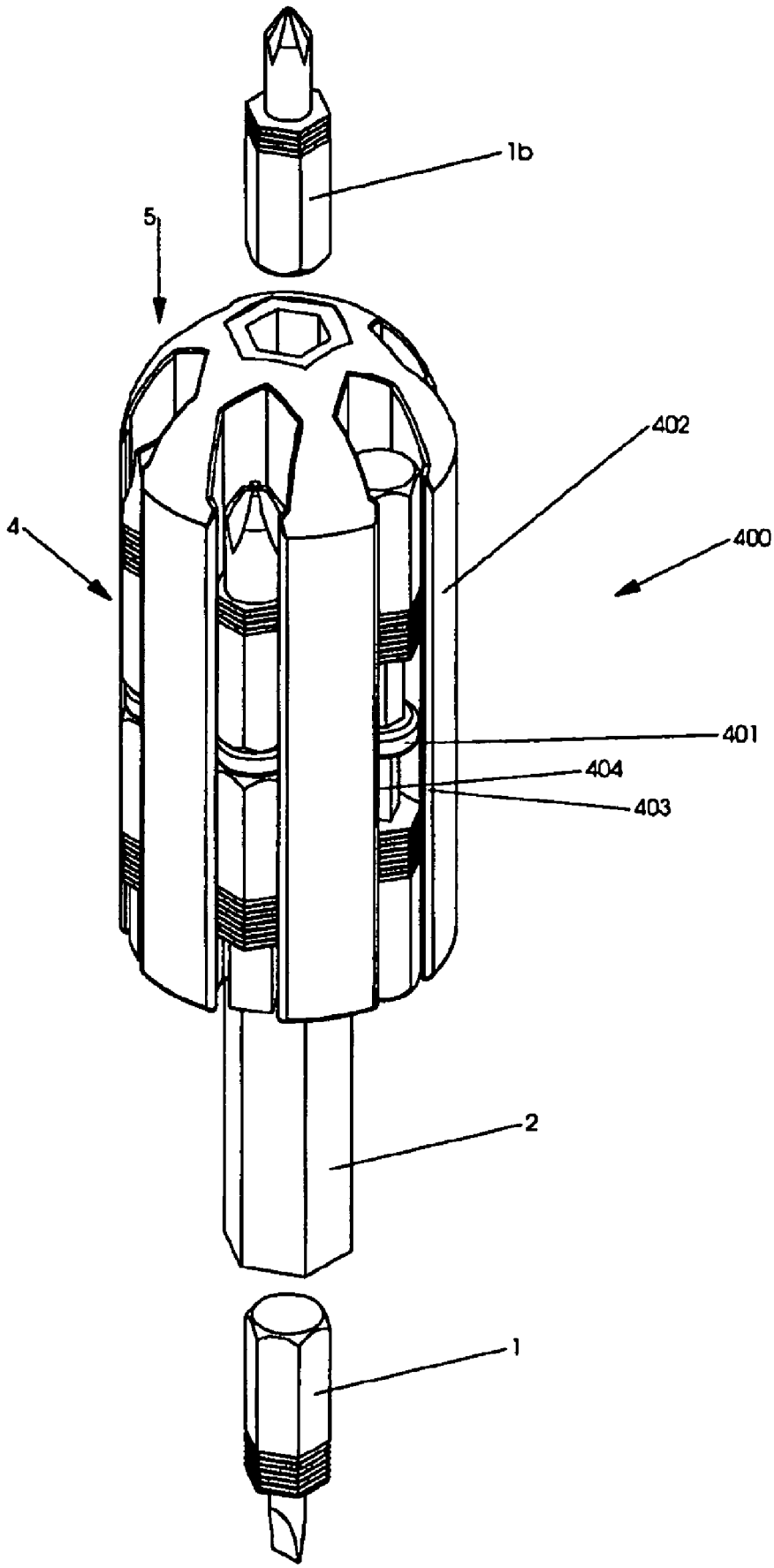
FIG. 12 illustrates a magnetic bit retention means formed within the storage handle.
Figure 14:
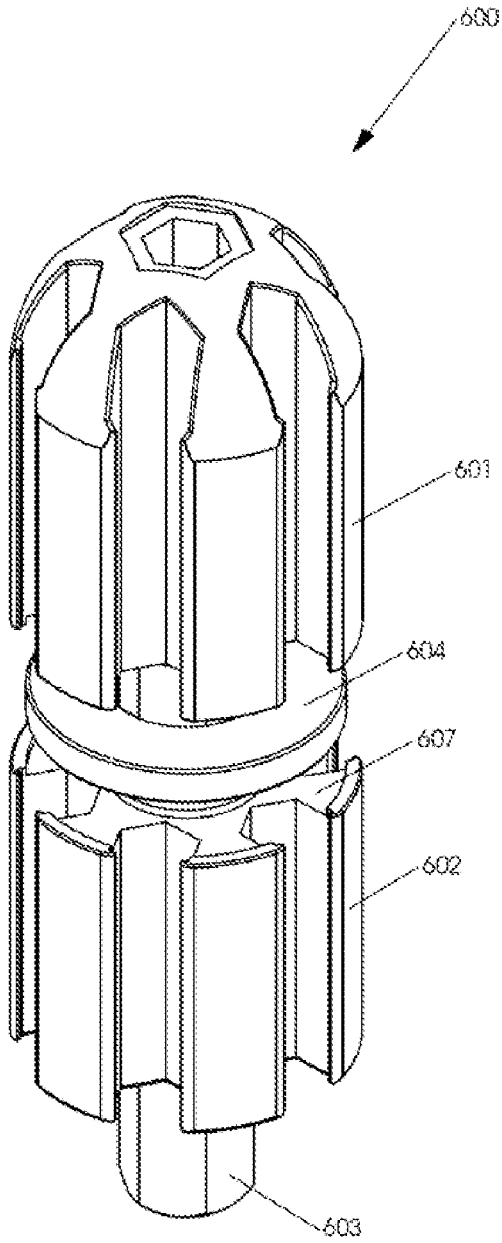
FIG. 14 illustrates one embodiment of a magnetic bit retention means that is formed within a two-part storage handle.
Figure 14A:
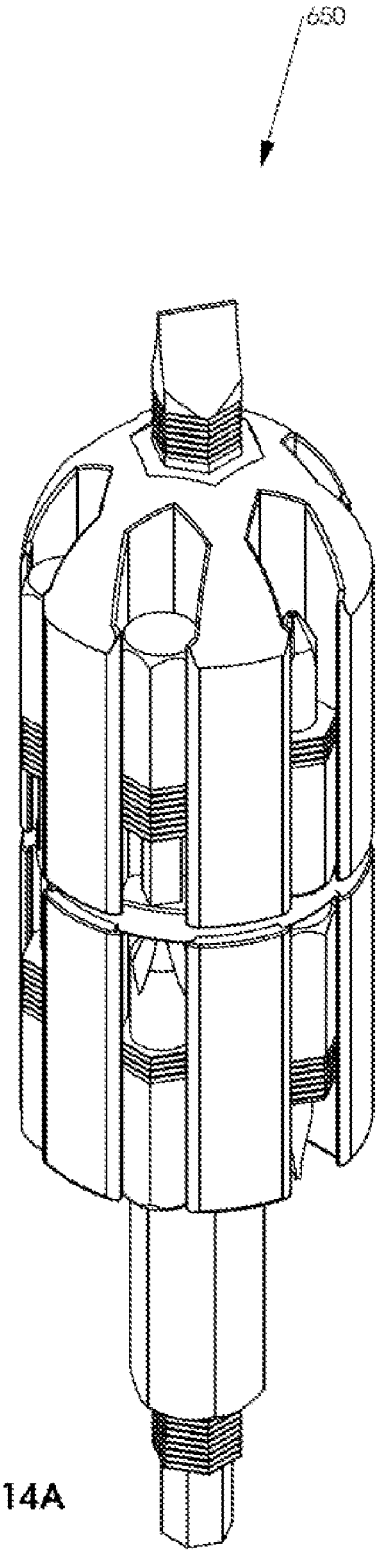
FIG. 14A illustrates the same embodiment of FIG. 14 with a magnetic bit retention means inserted between the top and bottom pieces of the handle.

Handgrip/bit-storage container 3 may include a textured surface to increase friction with the user's hand. In FIG. 5, a series of longitudinal hand-gripping grooves 14 provide such texture. The open-sided storage slots shown in FIG. 2 also provide adequate surface roughness to enhance gripping. FIGS. 11, 12 and 14 illustrate how the use of hexagonal bit-storage slots also provides grip-enhancing texture (from the exposed shank vertices of the stored bits).

In FIG. 5 each bit storage cavity is open at both ends and may contain one, two or more bits arranged axially within said cavity or slot. If the closed-sided storage cavity is long enough to contain more than a single screwdriver bit, then handgrip/bit-storage container 3 may include view-port 15 in order to permit the user to identify the tip of each stored bit. View-port 15 may be comprised of one or more grooves formed circumferentially into the handgrip/bit-storage container at a location and depth which reveals the stored bit-tips. Alternatively, view-port 15 may be comprised of individual apertures located so as to reveal each bit-tip (two examples are shown in 107 and 109 of FIG. 6*b*). In the preferred embodiment shown in FIG. 2, slot 8 of open-sided bit storage slot 5 permits both bit viewing and bit manipulation.

When not being used as a screwdriver or power actuated bit-driver, the handgrip portion 3 may serve strictly as a bit-storage system.

Referring to FIG. 10, when working with two bits in manual mode and repeatedly switching from one to the other, the user may insert a bit into each end so that the device can be flipped end-for-end to achieve rapid bit switching.

When used in power-driven mode, bits that are being repeatedly switched into the driven socket may be left partially protruding from their storage slot in order to facilitate rapid switching (not illustrated).

Referring to FIG. 8 and FIG. 1, standard screwdriver bits such as those grouped in 113 may be used with the present invention. Such bits typically measure 0.250", 0.375" or 4 mm face-to-face through their hexagonal shank portion. The ¼" bits are far more prevalent and used in a wide variety of magnetic bit-holders. The smaller ¼" bits can fit into the drive-sockets 6,7 formed in the ends of a ⅜" hexagonal driveshaft 2 thereby permitting a ⅜" drill chuck 201 to power this configuration (⅜" being the most popular commonly available chuck size). The screwdriver bits are typically either 1" long or 1.25" long (the two shortest standard sizes) however longer bits can be accommodated by using an appropriately sized handgrip/bit-storage container.

Shank 11 of bit 1 may have a series of knurling grooves 12 that improve the user's grip when extracting the bit from the magnetic grip of drive-socket 6, drive socket 7 or any of the bit-storage slots 5. Knurling 12 may extend just over the exposed portion of said bit shank (shown in FIG. 1 and on group 114 of FIG. 8). To simplify manufacturing, said knurling may be applied over all portions of said bit shank (shown on group 112 of FIG. 8). The knurled screwdriver bits shown in FIG. 8 may also be used in conjunction with a conventional, single-mode multi-bit screwdriver.

Figure 9:
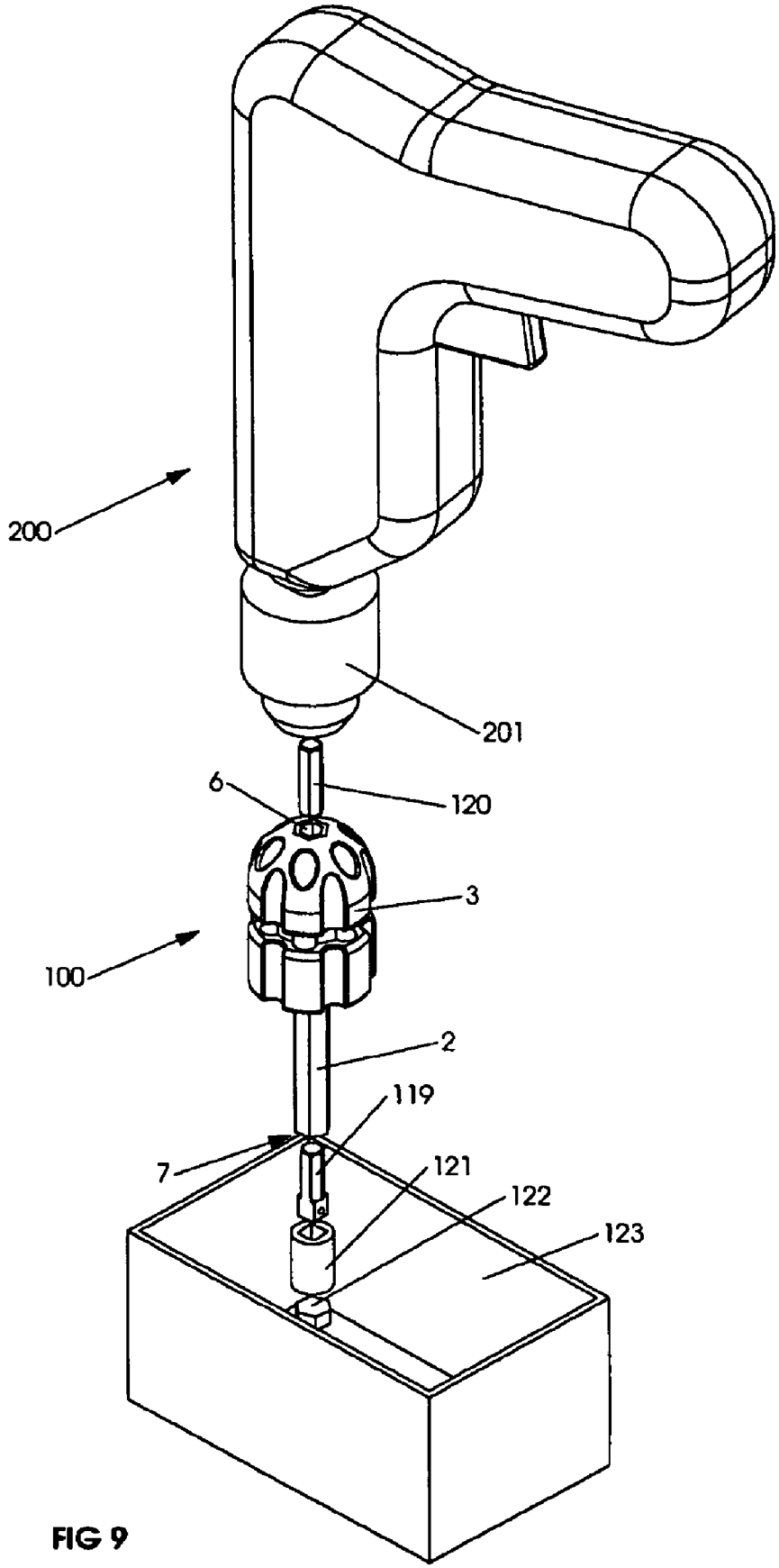
FIG. 9 illustrates the electric-drill powered embodiment configured for reaching into otherwise inaccessible areas. The illustrated deployment mode also facilitates more rapid conversion between hand-held and power-driven modes. This small adaptor configuration also permits small-chucked (¼") drills to power the invention.

Referring to both FIG. 8 and FIG. 9, various specialty bits may also be used within the scope of the present invention. When held in drive-socket 7, awl-bit 116 may be used to puncture-mark holes or scribe lines. When held in drive-socket 6 or drive-socket 7, ¼" square nut-driver adaptor 119 may be used to affix a standard nut-driver socket 121 to configuration 100.

Twist-drill-bit 118 incorporates a twist drill affixed to shank 11 instead of the typical screwdriver head shapes used in screwdriver bits. For wobble-free drilling, the shank to socket tolerance between 118 and its drive-socket should be closer than is normally used in replaceable-bit screwdrivers. Screwdriver bit gaps of 0.005"~0.008" are typical whereas gaps of 0.001"~0.003" are needed to minimize wobble of twist-drill-bit 118.

FIG. 9 illustrates means for applying torque onto fasteners in otherwise inaccessible workspaces. Box obstruction 123 prevents bolt-head 122 from being accessed in power-driven mode. In such conditions, power-adaptor 120 (comprised of a straight ¼" hex shank rod) is gripped in drill chuck 201 and mated into drive-socket 6, thereby rendering driveshaft 2 and drive-socket 7 suitable for power-driving with drill 200. Nut-driver adaptor 119 may then be used to drive nut 122 with nut-driver socket 121. If additional reach is required into more inaccessible workspaces (not illustrated) then standard bit-holder extension 117 may be utilized in between screwdriver driveshaft 2 and ¼" square nut-driver adaptor 119.

Embodiments that Facilitate Manufacturing the Invention

In the embodiments described above, side-friction between each stored screwdriver bit and its respective storage slot is used to prevent the bit from inadvertently falling out. Controlling this friction precisely enough that it provides just enough retention force to prevent bits from falling out while still gripping lightly enough for easy bit removal poses a significant manufacturing challenge. Rigorous dimensional tolerances on each bit storage slot are required as well as precise mechanical compression characteristics for the material or materials used to form the handle/bit-storage container. Non-frictional bit retention means are therefore desirable.

FIG. 12 illustrates an embodiment 400 that uses a plurality of axially polarized disk magnets 401 to retain the plurality of screwdriver bits 4 within the plurality of storage slots 5 (one magnet per slot, each magnet retaining two bits). In this embodiment of a magnetic bit-retention means, each magnet 401 is glued inside its respective bit-storage slot 5. The plurality of magnets 401 are glued in place near the midpoint of each of the plurality of storage slots 5. Each hexagonal bit-storage slot measures just slightly wider than 0.250" (in order to permit ¼" bits to slide freely in and out). The illustrated disk magnets are approximately ¼" in diameter, thereby providing four tangency points onto the storage slot's walls for gluing with a suitably viscous adhesive. Once affixed in their respective slots as illustrated, both sides of magnets 401 exert magnetic retention force onto screwdriver bits 4. The user stores a bit by sliding it into either end of a vacant storage slot until magnetic attraction snaps the bit into its stored location against magnet 401. As illustrated, bits may be stored with either its shank end or screwdriver bit end adjacent the magnet. The user removes a desired bit by inserting their finger into the slot formed between bit retention ridges 403 and 404 and then pushing on the desired bit until it's released from magnet 401.

Figure 13:
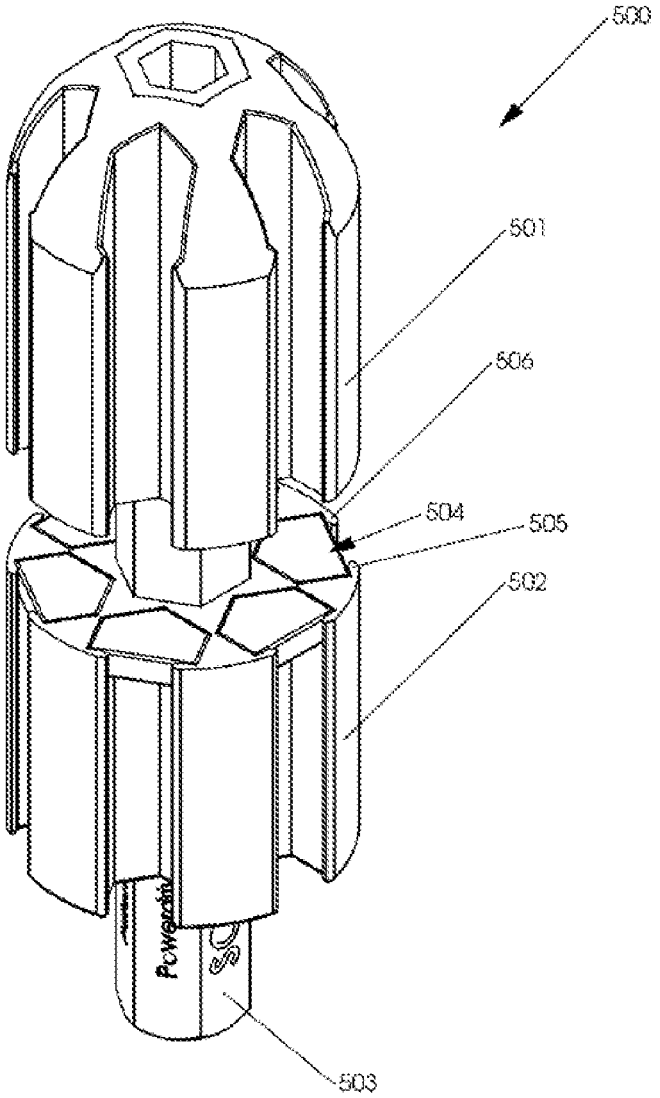
FIG. 13 illustrates one embodiment of a magnetic bit retention means that is formed within a two-part storage handle.
Figure 13A:
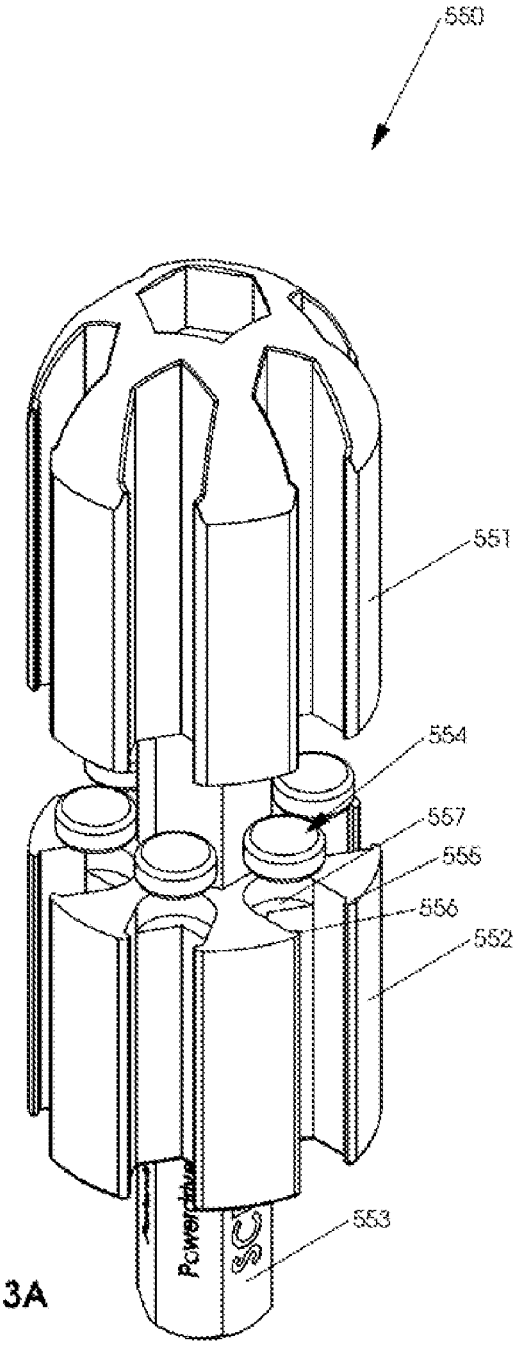
FIG. 13A illustrates another embodiment of a magnetic bit retention means.

FIG. 13 illustrates a more easily manufactured means of affixing bit-retention magnets in their respective bit-storage slot than that shown in FIG. 12. Configuration 500 utilizes two half-handle portions 501 and 502 which slide onto screwdriver driveshaft 503 during manufacture to form a handle/bit-storage container. A plurality of specially-formed magnets 504 are inserted into suitably formed recesses in one or both handle portions 501 and 502, thereby permitting the handle-halves to be glued together (and to their common screwdriver driveshaft 503) to form a an embodiment having the functionality shown in FIG. 12. The specialty magnets 504 shown captured between handle portions 501 and 502 have a flat outer surface, thereby providing a bit extra depth for finger insertion between slot edges 505 and 506. This extra depth (compared to disk-shaped magnets) can facilitate bit removal by exposing the bit's hexagonal end to improve the user's purchase on it. Configuration 550 is similar to 500 and shows the use of standard disk magnets 554 instead of purpose-made polygonal magnets 504. Disk-magnets 554 are shown prior to being inserted into suitably formed recesses 557 and subsequent bonding of all parts as described above.

FIG. 14 illustrates another means of facilitating manufacture of the preferred (magnetic) embodiment. Configuration 600 illustrates how (instead of capturing an individual magnet in the each bit-storage slot as described above) a single ring-shaped disk magnet 604 is captured between half-handle portions that are glued to driveshaft 603. Recess 607 prevents radial movement of magnet 604 and may be deep enough to completely hide the edge of ring magnet 604. Alternatively, recess 607 may be shallow enough to leave the magnet's edge visible for aesthetic purposes (as illustrated). Once assembled, the parts shown in configuration 600 produce the preferred embodiment of the invention shown in configuration 650. The use of a strong magnet for bit retention also facilitates storage to the invention. The magnetic embodiment will cling to any ferrous surface, thereby permitting it to act as a "fridge magnet" or to snap onto the inside cover of a metal toolbox for easy retrieval.

FIG. 15 illustrates an alternate assembly method that relies on mechanical locking of the two. handle halves 701 and 702 onto driveshaft 703, thereby speeding up the production process. Notches 704 and 705 are turned into driveshaft 703 and corresponding locking teeth 706 (and 708 in handle-half 702) are formed within the handle assembly's central driveshaft aperture 707. To assemble the invention, ring-shaped disk magnet 704 is fitted over driveshaft 703 and then handle halves 701 and 702 are forced onto its top and bottom ends respectively, thereby capturing the magnet and forming the complete handgrip/bit-storage assembly and also securing it to driveshaft 703. Handle halves 701 and 702 are typically injection molded from polycarbonate plastic. The snap fit of teeth 706 and 708 into notches 705 and 704 respectively may be facilitated by forcing the assembly together soon after molding (when the plastic is still somewhat malleable). If the plastic moldings 701 and 702 are sufficiently hot when forced onto driveshaft 703, shrinkage of the cooling parts may be sufficient to adequately secure the assembly without the need to form teeth 706, 708 for engagement into notches 705, 704.

This description contains much specificity that should not be construed as limiting the scope of the invention but merely provides illustrations of some of its embodiments. Thus the scope of the invention should be determined by the appended claims and their legal equivalents rather than by the examples given.

What is claimed is:

1. A dual-mode screwdriver having a manual and a powered actuation mode comprising a driveshaft having a top end having a first hexagonal socket therein for accepting a screwdriver bit and a bottom end having a second hexagonal socket therein for accepting said screwdriver bit; a cylindrical handgrip fixed to said driveshaft top end having a diameter, a circumference, domed top surface flush with the driveshaft top end and a flat bottom surface disposed above said driveshaft bottom end; six screwdriver bit storage slots co-linear with the driveshaft and disposed radially around said circumference of said handgrip, wherein each slot of said six slots has a top open end at said handgrip top domed surface, a bottom open end at said handgrip flat bottom surface and an exposed open side running from the domed top surface to the flat bottom surface; a bit retention magnet embedded within the handgrip and disposed between the handgrip domed top end and the handgrip flat bottom end in a slot bisecting arrangement thereby forming six top slots and six bottom slots, and wherein said manual actuation mode comprises the said handgrip is adapted for hand gripping and torquing and said driveshaft bottom end receives a screwdriver bit held in said second hexagonal socket for engagement with a work piece and the handgrip manually gripped and torqued; and wherein said powered actuation mode comprises the screwdriver bit held within said first hexagonal socket for engagement with said work piece and the driveshaft bottom end coupled to a powered rotation device.

2. The dual-mode screwdriver as claimed in claim 1 wherein each storage slot of said six top slots and said six bottom slots has a cross-section slightly greater than said screwdriver bit cross-section so that the screwdriver bit is stored unbiased within any of the six top slots and six bottom slots and can be removed from any of the slots by application of a sliding thumb force along said exposed open side sufficient to overcome magnetic forces of said retention magnet.

3. The dual-mode screwdriver as claimed in claim 1 wherein said domed top surface is configured to accept axial ergonomic hand pressure from the user in the manual actuation mode.

4. A dual-mode screwdriver having a manual and a powered actuation mode comprising a driveshaft having a top end having a first hexagonal socket therein for accepting a screwdriver bit and a bottom end having a second hexagonal socket therein for accepting said screwdriver bit; a cylindrical handgrip fixed to said driveshaft top end having a diameter, a circumference, domed top surface flush with the driveshaft top end and a flat bottom surface disposed above said driveshaft bottom end; six screwdriver bit storage slots co-linear with the driveshaft and disposed radially around said circumference of said handgrip, wherein each slot of said six slots has a top open end at said handgrip top domed surface, a bottom open end at said handgrip flat bottom surface and an exposed open side running from the domed top surface to the flat bottom surface; two opposing walls, and a cross-section that is slightly less than said screwdriver bit cross section so that the screwdriver bit stored within any of the six storage slots is biased by said two opposing walls and retained in place; and wherein said manual actuation mode comprises the screwdriver bit held within said second hexagonal socket for engagement with a work piece and the handgrip manually gripped and torqued; and, wherein said powered actuation mode comprises the screwdriver bit held within said first hexagonal socket for engagement with said work piece and the driveshaft bottom end directly coupled to a powered rotation device.

5. A dual-mode screwdriver having a manual and a powered actuation mode comprising a driveshaft having a top end having a first hexagonal socket therein for accepting a screwdriver bit having a cross-section and a bottom end having a second hexagonal socket therein for accepting said screwdriver bit; a cylindrical handgrip fixed to said driveshaft top end, having a diameter, a circumference, a domed top surface flush with the driveshaft top end and a flat bottom surface disposed above said driveshaft bottom end; six screwdriver bit storage bores co-linear with the driveshaft and disposed radially about the circumference of said handgrip, wherein each bore of said six storage bores has a top open end at said handgrip domed top surface, a bottom open end at said handgrip flat bottom surface, an internal biasing means for biasing a stored screwdriver bit, and a cross-section that is slightly less than said screwdriver bit cross section so that the screwdriver bit stored within any of the six storage bores is biased by said biasing means and retained in place such that it may be removed by insertion of a replacement stored bit; and wherein said manual actuation mode comprises the screwdriver bit held within said second hexagonal socket for engagement with a work piece and the handgrip manually gripped and torqued; and, wherein said powered actuation mode comprises the screwdriver bit held within said first hexagonal socket for engagement with said work piece and the driveshaft bottom end directly coupled to a powered rotation means.

* * * * *